US006017831A

United States Patent [19]

Beardsley et al.

[11] Patent Number: 6,017,831

[45] Date of Patent: Jan. 25, 2000

[54] NONWOVEN ABRASIVE ARTICLES

[75] Inventors: Kris A. Beardsley, Roseville; Jonathan M. Lise, Woodbury; Brent D. Niccum, North St. Paul, all of Minn.

[73] Assignee: 3M Innovative Properties Company, St. Paul, Minn.

[21] Appl. No.: 08/952,678

[22] PCT Filed: May 3, 1996

[86] PCT No.: PCT/US96/06287

§ 371 Date: Nov. 12, 1997

§ 102(e) Date: Nov. 12, 1997

[87] PCT Pub. No.: WO97/42005

PCT Pub. Date: Nov. 13, 1997

[51] Int. Cl.[7] ..... B24D 3/00; B24D 3/28; B24D 3/34; A47L 13/17

[52] U.S. Cl. ..... 442/68; 442/69; 442/74; 442/75; 442/148; 442/293; 51/295; 51/297; 51/298; 51/307

[58] Field of Search ..... 442/68, 69, 74, 442/75, 148, 293; 51/295, 297, 298, 307

[56] References Cited

U.S. PATENT DOCUMENTS

| | | |
|---|---|---|
| 211,576 | 1/1879 | Lawton et al. . |
| 412,321 | 10/1889 | Burkman . |
| 894,753 | 7/1908 | Smith . |

(List continued on next page.)

FOREIGN PATENT DOCUMENTS

| | | |
|---|---|---|
| 0 010 408 B1 | 2/1983 | European Pat. Off. . |
| 0 192 047 A2 | 8/1986 | European Pat. Off. . |
| 0 562 919 A1 | 9/1993 | European Pat. Off. . |
| 2.103.043 | 4/1972 | France . |
| 2.409.095 | 6/1979 | France . |
| 2.447.230 | 8/1980 | France . |
| 27 22 083 | 11/1978 | Germany . |
| 52-118689 | 10/1977 | Japan . |
| 55-112775 | 8/1980 | Japan . |
| 61-025776 | 2/1986 | Japan . |
| 2311273 | 12/1990 | Japan . |
| 5220670 | 8/1993 | Japan . |
| 396266 | 8/1973 | U.S.S.R. . |
| (11) 1093530A | 5/1984 | U.S.S.R. . |
| (11)1194665A | 11/1985 | U.S.S.R. . |
| 9(11)1553368A | 3/1990 | U.S.S.R. . |
| 939361 | 10/1963 | United Kingdom . |
| 1 328 292 | 8/1973 | United Kingdom . |
| 2 070 637 | 9/1981 | United Kingdom . |
| 2 224 489 | 5/1990 | United Kingdom . |
| WO 96/28256 | 9/1996 | WIPO . |
| WO 97/42003 | 11/1997 | WIPO . |

OTHER PUBLICATIONS

Spare Parts List PG 1–E Manual Enamel Gun, Gema Volstatic Industrial Powder Systems, Mar. 1992.

GEMA Brochure: "Power Delivery Control Unit".

Brochure: "American Industrial Corporation", 4730 Industrial Parkway, Indianapolis, In 46226.

Operating Instructions and Spare Parts List, "MPS 1–L Manual Powder System with the PG 1 Powder Gun", Gema Volstatic Industrial Powder Systems, Dec. 1990.

Kirk–Othmer "*Encyclopedia of Chemical Technology*", 3rd Edition, John Wiley & Sons 1981, New York, vol. 17, pp. 384–399.

*Primary Examiner*—Richard Weisberger

*Attorney, Agent, or Firm*—Daniel R. Pastirik; Scott A. Bardell

[57] ABSTRACT

Abrasive articles and a method for the manufacture of such articles are described. The articles comprise a lofty nonwoven web of fibers, the fibers defining a first major web surface, a second major web surface and a middle web portion extending between the first and second major web surfaces; and a plurality of abrasive particles adhered to the surfaces of the fibers of at least one of the first or second major web surfaces and distributed along the lengths of the fibers in a substantially uniform manner, the particles comprising a distribution of particle sizes having a median particle diameter of about 60 microns or less.

22 Claims, 4 Drawing Sheets

U.S. PATENT DOCUMENTS

| | | |
|---|---|---|
| 1,854,071 | 4/1932 | Schacht . |
| 2,307,698 | 1/1943 | Melton et al. . |
| 2,324,018 | 7/1943 | Petersen . |
| 2,596,565 | 5/1952 | Kautenberg . |
| 2,619,330 | 11/1952 | Willems . |
| 2,639,901 | 5/1953 | Teale . |
| 2,717,703 | 9/1955 | Kull et al. . |
| 2,958,593 | 11/1960 | Hoover et al. . |
| 3,175,331 | 3/1965 | Klein . |
| 3,401,491 | 9/1968 | Schnabel et al. . |
| 3,630,800 | 12/1971 | Nash et al. . |
| 3,701,703 | 10/1972 | Zimmer, Jr. et al. . |
| 3,773,480 | 11/1973 | Hall et al. . |
| 3,777,981 | 12/1973 | Probst et al. . |
| 3,875,892 | 4/1975 | Gregg et al. . |
| 3,918,220 | 11/1975 | Jury et al. . |
| 4,086,872 | 5/1978 | Pan . |
| 4,088,093 | 5/1978 | Pan . |
| 4,092,440 | 5/1978 | Wöhr et al. . |
| 4,094,760 | 6/1978 | Smith et al. . |
| 4,107,792 | 8/1978 | Dürr . |
| 4,111,668 | 9/1978 | Walker et al. . |
| 4,227,350 | 10/1980 | Fitzer . |
| 4,240,807 | 12/1980 | Kronzer . |
| 4,342,345 | 8/1982 | Nadin et al. . |
| 4,343,828 | 8/1982 | Smead et al. . |
| 4,384,787 | 5/1983 | Ito et al. . |
| 4,427,712 | 1/1984 | Pan . |
| 4,554,765 | 11/1985 | Grimes et al. . |
| 4,569,861 | 2/1986 | Smith et al. . |
| 4,613,345 | 9/1986 | Thicke et al. . |
| 4,652,274 | 3/1987 | Boettcher et al. . |
| 4,788,933 | 12/1988 | Buschor . |
| 4,826,703 | 5/1989 | Kisler . |
| 4,835,004 | 5/1989 | Kawanishi . |
| 4,856,931 | 8/1989 | Bollag . |
| 4,883,363 | 11/1989 | Pillon et al. . |
| 4,903,440 | 2/1990 | Larson et al. . |
| 4,966,609 | 10/1990 | Callinan et al. . |
| 4,969,975 | 11/1990 | Biggs et al. . |
| 4,991,362 | 2/1991 | Heyer et al. . |
| 5,025,596 | 6/1991 | Heyer et al. . |
| 5,082,720 | 1/1992 | Hayes . |
| 5,183,479 | 2/1993 | Grimes . |
| 5,222,663 | 6/1993 | Noakes et al. . |
| 5,236,472 | 8/1993 | Kirk et al. . |
| 5,238,709 | 8/1993 | Wilkie . |
| 5,242,718 | 9/1993 | Gillette et al. . |
| 5,242,749 | 9/1993 | Bayly et al. . |
| 5,250,326 | 10/1993 | Drummond et al. . |
| 5,279,863 | 1/1994 | Escallon . |
| 5,298,277 | 3/1994 | Hirose . |
| 5,307,593 | 5/1994 | Lucker et al. . |
| 5,320,879 | 6/1994 | Bullock . |
| 5,332,154 | 7/1994 | Maier et al. . |
| 5,340,616 | 8/1994 | Amano et al. . |
| 5,344,688 | 9/1994 | Peterson et al. . |
| 5,360,462 | 11/1994 | Harmer et al. . |
| 5,363,604 | 11/1994 | Heyer . |
| 5,366,523 | 11/1994 | Rowenhorst et al. . |
| 5,368,237 | 11/1994 | Fulkerson . |
| 5,368,618 | 11/1994 | Masmar et al. . |
| 5,374,456 | 12/1994 | Matossian et al. . |
| 5,378,252 | 1/1995 | Follensbee . |
| 5,409,162 | 4/1995 | Sickles . |
| 5,415,717 | 5/1995 | Perneborn . |
| 5,429,545 | 7/1995 | Meyer . |
| 5,431,963 | 7/1995 | Rzad et al. . |
| 5,464,667 | 11/1995 | Köhler et al. . |
| 5,482,756 | 1/1996 | Berger et al. . |
| 5,573,844 | 11/1996 | Donovan et al. . |
| 5,580,647 | 12/1996 | Larson et al. . |
| 5,609,513 | 3/1997 | Stark . |
| 5,681,361 | 10/1997 | Sanders, Jr. . |

NONWOVEN ABRASIVE ARTICLES

CROSS REFERENCE TO RELATED APPLICATION

This application is a National Application filed under 35 U.S.C. §371 from International Application No. PCT/US96/06287, filed on May 3, 1996.

The present invention relates to abrasive articles having a desired distribution of fine abrasive particles.

BACKGROUND OF THE INVENTION

Nonwoven webs comprising open, lefty, three dimensional structures of fibers bonded to one another at their mutual contact points are used extensively in the manufacture of abrasive articles for cleaning, abrading, finishing and polishing applications on any of a variety of surfaces. Exemplary of such nonwoven articles are those described in U.S. Pat. No. 2,958,593 to Hoover et al. Such nonwoven webs comprise a suitable fiber such as nylon, polyester, blends thereof and the like and are capable of withstanding temperatures at which impregnating resins and adhesive binders are typically cured. The fibers of the web are often tensilized and crimped but may also be continuous filaments formed by an extrusion process such as that described in U.S. Pat. No. 4,227,350 to Fitzer, for example. Nonwoven webs are readily formed on conventional equipment such as a "Rando Webber" machine (commercially available from Rando Machine Company, New York), for example.

Fine abrasive particles (defined herein as particles having a distribution of sizes wherein the median particle diameter in the distribution is about 60 microns or less) may be bonded to the fibers of a nonwoven web to provide abrasive articles suitable for use in any of a variety of abrasive applications, and such articles may be provided in the form of endless belts, discs, hand pads, densified or compressed wheels, floor polishing pads and the like. A particularly appropriate use for articles comprising the aforementioned fine particles is in the automotive aftermarket industry, where the abrasive particles are employed to "scuff" or lightly abrade automobile body panels in preparation for painting. In these applications, the abrasive article is applied to a previously painted surface. During the application, the abrasive particles in the article scratch the surface to reduce the surface gloss to a "haze". Although the commercial success of available abrasive articles has been impressive, it is desirable to further improve the performance of certain abrasive articles especially in applications in the automotive aftermarket, for example.

In the manufacture of these articles, a nonwoven web is prepared, as mentioned. The web is reinforced, for example, by the application of a prebond resin to bond the fibers at their mutual contact points. Additional resin layers may subsequently be applied to the prebonded web. A make coat precursor is applied over the fibers of the prebonded web and the make coat precursor is at least partially cured. A size coat precursor may be applied over the make coat precursor and both the make coat precursor and the size coat precursor are sufficiently hardened in a known manner (e.g., by heat curing). Fine abrasive particles, when included in the construction of the article, are conventionally applied to the fibers in a slurry with the make coat precursor.

Prior to or during the curing of the make coat, the resinous slurry of make coat precursor and fine abrasive particles is known to migrate and to concentrate or agglomerate at the intersection of two or more fibers in the web, or at points where a single fiber crosses itself due to known surface tension effects, for example. The resulting abrasive articles have a substantially nonuniform distribution of the agglomerated resin and the fine abrasive particles along the lengths of the fibers. Further, because the particles are applied to the web in a resinous slurry, the fine abrasive particles tend to become engulfed in the cured resin, as is illustrated in FIG. 1 wherein the resinous adhesive forms agglomerates 12 along the lengths of the fibers 10 of the nonwoven web with the fine abrasive particles dispersed and engulfed within the resin. In such a construction, the fine abrasive particles may not be immediately available in abrading applications of the finished article, possibly making the overall abrasive performance of the articles less than optimum and leaving room for improvement in performance. In the automotive aftermarket industry, for example, the initial unavailability of the abrasive particles can result in an undesirably low initial abrasive action when the article is applied to the surface, prompting the user to exert high pressures on the article during the abrasive operation which may have an undesired effect on the surface being treated.

Historically, lofty, open, 3-dimensional nonwoven abrasive articles have been made using a variety of coating techniques. In the aforementioned U.S. Pat. No. 2,958,593 (Hoover et al.) for example, nonwoven articles were made by the spray application of a relatively dilute slurry comprising a solution of binder, organic solvent and abrasive particles. It was expected that other coating methods and procedures might provide advantages under specific circumstances.

From Hoover et al.:

It should be noted, however, that by employing techniques other than spraying, somewhat greater thicknesses of web may be suitably treated in forming our structures. In fact, roll coating, dip coating, separate application of adhesive and mineral, etc., may have advantages over the spray application described in the previous examples. For instance, spraying the adhesive first and then sifting in the abrasive separately is particularly suitable for incorporating coarse mineral, (e.g. grit 50 or larger), and also results in products of slightly differing abrading characteristics.

With the passage of time, it became desirable to minimize resin waste from overspray and minimize or eliminate volatile organic compounds from use in the manufacturing process. Consequently, the spray coating techniques exemplified by Hoover et al. generally fell into disfavor, and the present day use of roll coating techniques to apply water-based resin/abrasive slurries began in earnest. As the performance characteristics of nonwoven abrasive articles became more demanding, the resin/abrasive coatings employed in the manufacture of nonwoven abrasive articles and methods for the application of such coatings have continued to evolve. However, the foregoing problem of uniformly coating fine abrasive particles onto the fibers of a nonwoven web has persisted.

Efforts to overcome the problem of resin and particle agglomeration in the application of fine abrasive particles to nonwovens include attempted drop coating or spray coating techniques, as taught or suggested by Hoover et al. In these efforts, dry abrasive particles are deposited onto the fibers of the web after the application of the uncured make coat precursor. However, in the deposition of fine abrasive particles by these techniques, the distribution of the particles is greatly influenced by electrostatic forces and ambient moisture conditions which occur naturally in the materials (e.g., the particles) and in the equipment used in the deposition process. As a result of these forces, fine abrasive particles have shown a consistent tendency to agglomerate while still resident within the coating equipment as well as after the particles have been released therefrom. This particle to particle interaction or agglomeration may result in abrasive articles comprising significant particle agglomerates with non-uniform particle distributions within the resulting webs. Such articles may possess nonuniform performance characteristics, and the nonuniformity of the particle distribution, with the presence of particle agglomerates, can create a commercially unacceptable appearance in the article. Moreover, standard roll coating techniques used in the application of the make coat precursor can add excessive amounts of the resin to the web, resulting in resin layers which can readily engulf fine abrasive particles once they are applied to the web.

Accordingly, it is desirable to solve the above described problem and to thereby fulfill a long felt need relating to the optimization of fine abrasive particle distribution in nonwoven abrasive articles. It is desirable to provide nonwoven abrasive articles comprising a nonwoven web with fine abrasive particles adhered to the fibers of the web wherein the particles are distributed along the lengths of the fibers of the web in a substantially uniform manner and wherein an increased percentage of the abrasive particles are immediately available for abrasive applications of the finished article.

SUMMARY OF THE INVENTION

The present invention provides nonwoven abrasive articles which include fine abrasive particles adhered to the fibers of a nonwoven web in a desirable particle distribution. The articles are useful in abrasive applications such as finishing and polishing of metal, wood and plastic surfaces, for example, and especially in the automobile aftermarket industry where the articles are useful to treat painted automobile panels and the like. In the manufacture of such articles, fine abrasive particles are deposited onto the fibers of the nonwoven web so that the particles are distributed in a substantially uniform manner along the surfaces of the fibers to provide an abrasively effective article.

In describing the present invention, "prebond resin" refers to a coatable resinous adhesive applied directly to the fibers of an unbonded nonwoven web in order to bond the fibers together at their mutual contact points. "Prebonded web" refers to a nonwoven web wherein the fibers of the web have been treated with a prebond resin and the resin has been hardened to bond the fibers at their mutual contact points. "Make coat precursor" refers to the coatable resinous adhesive material applied to the fibers of the nonwoven web to secure abrasive particles thereto. "Make coat" refers to the layer of hardened resin over the fibers of the nonwoven web formed by hardening the make coat precursor. "Size coat precursor" refers to the coatable resinous adhesive material applied to the fibers of the nonwoven web over the make coat. "Size coat" refers to the layer of hardened resin over the fibers of the nonwoven web formed by hardening the size coat precursor. "Cured" or "fully cured" means a hardened polymerized curable coatable resin. "Fiber" refers to a threadlike structure. "Fine abrasive particles" refers to abrasively effective particles comprising any of the materials set forth herein and having distribution of particle sizes wherein the median particle diameter is about 60 microns or less. A spherical particle shape is assumed in referring to the median particle diameter, based on standard test methods available for the determination of particle diameters such as, for example ANSI test method B74.18-1884. "Substantially uniform" in referring to the distribution of fine abrasive particles along the length of the fibers means that the particles in the finished articles are distributed along the lengths of the fibers without significant agglomeration of the resin and the particles, as may be visually observed by microscopic examination of the fibers. In the finished article, the majority of the particles are positioned along the fibers to be abrasively effective in the initial application of the article.

In referring to the binder compositions of the make and size coats, "Labile" means a foamed condition imparted to a liquid dispersion of binder material (e.g., a make coat precursor or a size coat precursor) so that the foamed state of the binder dispersion is transitory. By the term "foam", it is meant a dispersion of gas bubbles throughout a liquid where each bubble is enclosed within a thin film of the liquid. The labile foams utilized in the invention thus also encompass "froths" or unstable foam consisting of relatively large bubbles of gas.

In one aspect, the invention provides an abrasive article, comprising:

a nonwoven web of fibers bonded to one another, the fibers defining a first major web surface, a second major web surface and a middle web portion extending between the first and second major web surfaces, the fibers each having a surface and a length; and a plurality of abrasive particles adhered to the surfaces of the fibers of at least one of the first or second major web surfaces and distributed along the lengths of the fibers in a substantially uniform manner, the particles comprising a distribution of particle sizes having a median particle diameter of about 60 microns or less.

The fibers of the nonwoven web may be bonded to one another at their points of mutual contact by utilizing a prebonded web or a web comprising melt bondable fibers bonded to one another at their mutual contact points by a melted component of the fibers. The web may also be consolidated by needle tacking, for example. Additionally, the fibers of the nonwoven web may be bonded to one another at first and second bonding sites with a nonbonded portion of the filament array in between the first and second bonding sites. Fine abrasive particles are preferably dispersed throughout the web. However, it is also contemplated that only the fibers of the first and/or second major web surfaces will include fine abrasive particles adhered thereto, and the particles may comprise any of a variety of suitable abrasive materials. The particles are bonded to the fibers of the nonwoven web with a suitable adhesive which may comprise thermoplastic or thermosetting resins. Preferably, the particles are secured to the fibers utilizing a thermosetting phenolic resin make coat and, optionally, a similar size coat. The articles of the invention may be provided in the form of hand pads, endless belts, discs, densified or compressed wheels and the like. Additionally, the articles of the invention can be laminated to other articles such as sponges and the like or the articles can be provided a in a roll form with or without perforations therein.

In the preparation of the foregoing articles, a lofty nonwoven web of fibers is prepared or is otherwise provided. A make coat precursor composition is applied to the external surface of the fibers to form a first coating layer. A plurality of the foregoing fine abrasive particles is applied to the first coating layer, and the make coat precursor composition is at least partially cured. Optionally, a size coat precursor composition is applied over the abrasive particles and the first coating layer to form a second coating layer. The first and second coating layers are cured to affix the abrasive particles to the fibers of the nonwoven web to provide the abrasive article wherein the particles are affixed to the fibers in a substantially uniform distribution along the lengths thereof.

The fine abrasive particles are deposited onto the make coat precursor, preferably by depositing the particles first on one major surface of the web and then over the second major surface of the web using the deposition method described in commonly assigned co-pending U.S. patent application Ser. No. 08/930,098, entitled "Method Of Manufacturing Nonwoven Articles", filed concurrently herewith, now U.S. Pat. No. 5,863,305. Preferably, the make and size coat precursors are thermosetting, coatable, phenolic resins which are provided as labile foams. The make coat precursor is frothed prior to its application to the web, and is thereafter allowed to at least partially break down prior to the application of abrasive particles. Likewise, the optional size coat, when applied to the article, is preferably frothed and then applied over the at least partially cured make coat. The make coat precursor and size coat precursor are then fully cured to provide the abrasive articles of the invention, and the thus prepared articles may be further processed to provide hand pads, endless belts, discs, densified or compressed wheels and the like.

The additional details of the invention will be more fully appreciated by those skilled in the art upon consideration of the remainder of the disclosure including the detailed description of the preferred embodiment and the appended claims.

BRIEF DESCRIPTION OF THE DRAWINGS

In describing the various aspects of the preferred embodiment, reference is made to the Figures, wherein.

DETAILED DESCRIPTION OF THE PREFERRED EMBODIMENT

Figure 1:
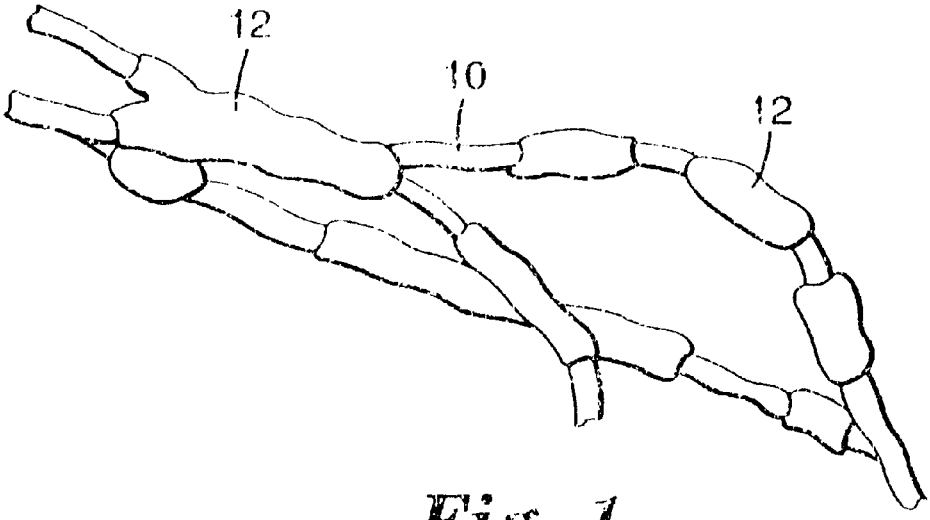
Fig. 1 PRIOR ART
FIG. 1 is an enlarged view of a portion of a prior art abrasive article showing individual fibers of a nonwoven web.

Details of the preferred embodiment of the invention will now be described. It will be understood by those skilled in the art that the details of the embodiments discussed below are not intended to be limiting in any way but merely illustrative of the features of the invention. In describing the preferred embodiment, reference is made to the figures wherein structural features are identified by reference numerals and wherein identical reference numerals indicate identical structures.

Figure 2:
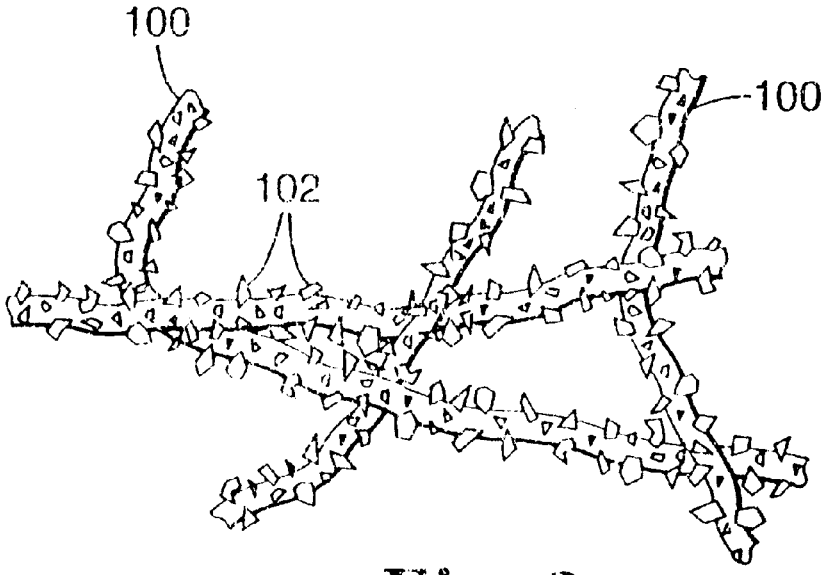
FIG. 2 is an enlarged view of a portion of a abrasive article showing individual fibers with abrasive particles adhered to the surface of the fibers according to the invention.

As shown in FIG. 2, the articles of the invention comprise an open, lofty, nonwoven web of fibers 100 which preferably have been bonded to one another at their mutual contact points by a cured prebond resin. Alteratively, the web can comprise melt bondable biocomponent fibers wherein the fibers are of a sheath-core or side by side configuration and which have been heated to the melting point of at least one component of the fibers to cause melt bonding between the fibers at their contact points. Suitable melt bondable fibers include those described by Hayes et al. in U.S. Pat. No. 5,082,720, the disclosure of which is incorporated herein by reference. A plurality of fine abrasive particles 102 are bonded to the fibers 100 by cured resinous binders applied to the web to provide make and size coats, as described herein. The abrasive particles 102 are arranged in a preferred distributor along the fibers 100 so that the particles 102 are distributed in a substantially uniform manner along the fibers and without burying the fibers in agglomerated resin. In this construction, the particles 102 are positioned to be immediately effective in initial abrasive applications of the finished article, such as in the treatment of painted automobile body panels, for example.

The nonwoven web suitable for use in the articles of the invention may be made of an air-laid, carded, stitch-bonded, spunbonded, wet laid, or melt blown construction. A preferred nonwoven web is the open, loft, three-dimensional air-laid nonwoven substrate described by Hoover et al. in U.S. Pat. No. 2,958,593, incorporated herein by reference. Alternatively, the nonwoven web used herein can be a low density nonwoven article formed of a multiplicity of crimped filaments (e.g., thermoplastic filaments) wherein one end of substantially all of the filaments are bonded together at a first bonding site and a second end of substantially all of the filaments are bonded together at a second bonding site with a nonbonded portion of the filament array in between the first and second bonding sites. Such a nonwoven web is described in U.S. Pat. Nos. 4,991,362 and 5,025,596, both to Heyer et al. the disclosures of which are incorporated herein by reference.

The nonwoven web preferably comprises a first major web surface, a second major web surface, and a middle web portion extending between the first and second major web surfaces. The web is made of a suitable synthetic fiber capable of withstanding the temperatures at which impregnating resins and adhesive binders are cured without deterioration. Fibers suitable for use in the articles of the invention include natural and synthetic fibers, and mixtures thereof. Synthetic fibers are preferred including those made of polyester (e.g., polyethylene terephthalate), nylon (e.g., hexamethylene adipamide, polycaprolactum), polypropylene, acrylic (formed from a polymer of acrylonitrile), rayon, cellulose acetate, polyvinylidene chloride-vinyl chloride copolymers, vinyl chloride-acrylonitrile copolymers, and so forth. Suitable natural fibers include those of cotton, wool, jute, and hemp. The fiber used may be virgin fibers or waste fibers reclaimed from garment cuttings, carpet manufacturing, fiber manufacturing, or textile processing, for example. The fiber material can be a homogenous fiber or a composite fiber, such as bicomponent fiber (e.g., a co-spun sheath-core fiber). It is also within the scope of the invention to provide an article comprising different fibers in different portions of the web (e.g., the first web portion, the second web portion and the middle web portion). The fibers of the web are preferably tensilized and crimped but may also be continuous filaments formed by an extrusion process such as that described in U.S. Pat. No. 4,227,350 to Fitzer, incorporated herein by reference, as well as the continuous fibers described by the aforementioned '362 and '596 patents to Heyer et al.

Where the nonwoven web is of the type described by Hoover et al., identified above, satisfactory fibers for use in the nonwoven web are between about 20 and about 110 millimeters and preferably between about 40 and about 65 millimeters in length and have a fineness or linear density ranging from about 1.5 to about 500 denier and preferably from about 15 to about 110 denier. It is contemplated that fibers of mixed denier can be used in the manufacture of a nonwoven web in order to obtain a desired surface finish. The use of larger fibers is also contemplated, and those skilled in the art will understand that the invention is not limited by the nature of the fibers employed or by their respective lengths, linear densities and the like.

The aforementioned nonwoven web is readily formed on a "Rando Webber" machine (commercially available from Rando Machine Company, New York) or may be formed by other conventional processes. Where a spunbonded-type nonwoven material is employed, the filaments may be of substantially larger diameter, for example, up to 2 millimeters or more in diameter. Useful nonwoven webs preferably have a weight per unit area at least about 50 g/m$^2$, preferably between 50 and 200 g/m$^2$, more preferably between 75 and 150 g/m$^2$. Lesser amounts of fiber within the nonwoven web will provide articles which may be suitable in some applications, but articles with lower fiber weights may have somewhat shorter commercial work lives. The foregoing fiber weights typically will provide a web, before needling or impregnation, having a thickness from about 5 to about 200 millimeters, typically between 6 to 75 millimeters, and preferably between 10 and 30 millimeters.

The nonwoven web may optionally be reinforced and consolidated by needle tacking, a treatment which mechanically strengthens the nonwoven web by passing barbed needles therethrough. During this treatment, the needles pull the fibers of the web with them while they pass through the nonwoven web so that, after the needle has retracted, individual collections of fibers of the web are oriented in the thickness direction of the nonwoven fabric. The amount or degree of needle tacking may include the use of about 8 to about 20 needle penetrations per square centimeter of web surface when 15×18×25×3.5 RB, F20 6-32-5.5B/3B/2E/L90 needles (commercially available from Foster Needle Company, Manitowoc, Wis.) are used. Needle tacking is readily accomplished by use of a conventional needle loom which is commercially available from, for example, Dilo, Inc. of Charlotte, N.C.

Where the web is to be incorporated into machine driven abrasive articles such as endless belts or abrasive discs, a reinforcing fabric backing may be applied and affixed to one of the major surfaces of the web. The reinforcing fabric is preferably a woven stretch-resistant fabric with a low-stretch value when pulled in opposing directions. A stretch value of less than about 20% is preferred and a value of less than about 15% is more preferred. Suitable materials for use as the reinforcing fabric in the articles of the invention include, without limitation, thermobonded fabrics, knitted fabrics, stitch-bonded fabrics and the like. Those skilled in the art will appreciate that the invention is not to be limited to the selection of one reinforcing fabric over another, and it is contemplated that the invention can include any type of material which otherwise has the requisite properties as set forth herein. The fabric backing may be adhesively affixed to the nonwoven web or it may be affixed during the aforementioned needletacking step, all in a known manner. An additional layer comprising a suitable polymer may then be applied over the exposed surface of the fabric backing in the manner described in commonly assigned U.S. Pat. No. 5,482,756, issued Jan. 9, 1996 and incorporated herein by reference, or in the manner described in commonly assigned U.S. patent application Ser. No. 08/369,933 filed Jan. 6, 1995, now U.S. Pat. No. 5,573,844, incorporated herein by reference.

The prebond resin, when used to bond fibers in the web to one another at their mutual contact points, preferably comprises a coatable resinous adhesive similar or identical to the resin used for the make coat precursor, described below. More preferably, the prebond is made of a thermosetting water based phenolic resin. The prebond is applied to the web in a relatively light coating, typically providing a dry add-on weight within the broad range from about 50 to 200 g/m$^2$ for phenolic prebond resins applied to a nonwoven web having a fiber weight within the above ranges. Polyurethane resins may also be employed as well as other resins, and those skilled in the art will appreciate that the selection and amount of resin actually applied can depend on any of a variety of factors including, for example, the fiber weight in the nonwoven web, the fiber density, the fiber type as well as the contemplated end use for the finished article. Of course, the present invention does not require the use of a prebond resin and the invention is not to be constructed as being limited to nonwoven webs comprising any particular prebond resin.

As is described in more detail below, an adhesive layer is formed from the application to the web of a resinous make coat precursor or first resin and, optionally, a size coat precursor or second resin applied over the make coat precursor. Preferably, the adhesive layer is formed from the make coat precursor and the size coat precursor which have been applied to the web at a coating weight which, when hardened, provides the necessary adhesion to strongly bond abrasive particles to the fibers. In the finished articles of the invention, the adhesive layer provide sa light coating of resin over the fine abrasive particles without burying the particles within the resin. When observed under a microscope, for example, the individual particles are observed to be anchored to the fibers and to extend outwardly from the outer surfaces of the fibers. In this construction, the fine abrasive particles are positioned in the article to be immediately abrasively effective in the initial applications of the finished article. Moreover, the particles are strongly adhered to the fibers of the web to provide an abrasive article with a satisfactory work life.

The make coat precursor suitable for use in the invention is a coatable, hardenable adhesive binder and may comprise one or more thermoplastic or, preferably, thermosetting resinous adhesives. Resinous adhesives suitable for use in the present invention include phenolic resins, aminoplast resins having pendant $\alpha,\beta$-unsaturated carbonyl groups, urethane resins, epoxy resins, ethylenically unsaturated resin, acrylated isocyanurate resins, urea-formaldehyde resins, isocyanurate resins, acrylated urethane resins, acrylated epoxy resins, bismaleimide resins, fluorene-modified epoxy resins, and combinations thereof. Catalysts and/or curing agents may be added to the binder precursor to initiate and/or accelerate the polymerization process.

Epoxy resins have an oxirane and are polymerized by the ring opening. Such epoxide resins include monomeric epoxy resins and polymeric epoxy reins. These resin can vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of acceptable substituent groups include halogens, ester groups, ether groups, sulfonate groups, siloxane groups, nitro groups and phosphate groups. Examples of some preferred epoxy resins include 2,2-bis[4-(2,3-epoxypropoxy)-phenyl)propane (diglycidyl either of bisphenol a)] and commercially available materials under the trade designation "Epon 828", "Epon 1004" and "Epon 1001F" available from Shell Chemical Co., "DER-331", "DER-332" and "DER-334" available from Dow Chemical Co. Other suitable epoxy resins include glycidyl ethers of phenol formaldehyde novolac (e.g., "DEN-431" and "DEN-428" available from Dow Chemical Co.

Examples of ethylenically unsaturated binder precursors include aminoplast monomer or oligomer having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions or mixtures thereof.

The aminoplast binder precursors have at least one pendant alpha, beta-unsaturated carbonyl group per molecule or oligomer. These materials are further described in U.S. Pat. Nos. 4,903,440 (Larson et al.) and 5,236,472 (Kirk et al.), both incorporated herein by reference.

The ethylenically unsaturated monomers or oligomers may be monofunctional, difunctional, trifunctional or even higher functionality. The term acrylate includes both acrylates and methacrylates. Ethylenically unsaturated binder precursors include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated compounds preferably have a molecule weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryl-oxyethyl) isocyanurate, 1,3,5-tri(2-methyacryloxyethyl)-s-triazine, acrylamide, methylacrylamide, N-methyl-acrylamide, N,N-dimethylacrylamide, N-vinyl-pyrrolidone, and N-vinyl-piperidone.

Isocyanurate derivatives having at least one pendant acrylate group and isocyanurate derivatives having at least one pendant acrylate group are further described in U.S. Pat. No. 4,652,274 (Boettcher et al.), incorporated herein by reference. The preferred isocyanurate material is a triacrylate of tris(hydroxy ethyl)isocyanurate.

Acrylated urethanes are diacrylate esters of hydroxy terminated isocyanate extended polyesters or polyethers. Examples of commercially available acrylated urethanes include "UVITHANE 782", available from Morton Chemical, and "CMD 6600", "CMD 8400", and "CMD 8805", available from UCB Radcure Specialties. Acrylated epoxies are diacrylate esters of epoxy resins, such as the diacrylate esters of bisphenol A epoxy resin. Examples of commercially available acrylated epoxies include "CMD 3500", "CMD 3600", and "CMD 3700", available from UCB Radcure Specialties.

Acrylated urethanes are diacrylate esters of hydroxy terminated NCO extended polyesters or polyethers. Examples commercially available acrylated urethanes include UVITHANE 782, available from Morton Thiokol Chemical, and CMD 6600, CMD 8400, and CMD 8805, available from Radcure Specialties.

Acrylated epoxies are diacrylate esters of epoxy resins, such as the diacrylate esters of bisphenol A epoxy resin. Examples of commercially available acrylated epoxies include CMD 3500, CMD 3600, and CMD 3700, available from Radcure Specialties.

Examples of ethylenically unsaturated diluents or monomers can be found in U.S. patent application Ser. No. 08/5,236,472 (Kirk et al.) and U.S. patent application Ser. No. 08/144,199 (Larsen et al.); the disclosures of both patent applications are incorporated herein by reference. In some instances these ethylenically unsaturated diluents are useful because they tend to be compatible with water.

Additional details concerning acrylate dispersions can be found in U.S. Pat. No. 5,378,252 (Follensbee), incorporated herein by reference.

It is also within the scope of this invention to use a partially polymerized ethylenically unsaturated monomer in the binder precursor. For example, an acrylate monomer can be partially polymerized and incorporated into the make coat precursor. The degree of partial polymerization should be controlled so that the resulting partially polymerized ethylenically unsaturated monomer does not have an excessively high viscosity so that the binder precursor is a coatable material. An example of an acrylate monomer that can be partially polymerized is isooctyl acrylate. It is also within the scope of this invention to use a combination of a partially polymerized ethylenically unsaturated monomer with another ethylenically unsaturated monomer and/or a condensation curable binder.

In the manufacture of hand pads for use in the automotive applications mentioned above, the adhesive materials used as the make coat precursor in the present invention preferably comprise thermosetting phenolic resins such as resole and novolac resins, described in Kirk-Othmer, *Encyclopedia of Chemical Technology,* 3d Ed. John Wiley & Sons, 1981, New York, Vol. 17, pp. 384–399, incorporated herein by reference. Resole phenolic resins are made with an alkaline catalyst and a molar excess of formaldehyde, typically having a molar ratio of formaldehyde to phenol between 1.0:1.0 and 3.0:1.0. Novolac resins are prepared under acid catalysis and with a molar ratio of formaldehyde to phenol less than 1.0:1.0. A typical resole resin useful in the manufacture of articles of the present invention contains between about 0.75% (by weight) and about 1.4% free formaldehyde; between about 6% and about 8% free phenol; about 78% solids with the remainder being water. The pH of such a resin is about 8.5 and the viscosity is between about 2400 and about 2800 centipoise. Commercially available phenolic resins suitable for use in the present invention include those known under the trade designations "Durez" and "Varcum", available from Occidental Chemicals Corporation (N. Tonawonda, N.Y.); "Resinox", available from Monsanto Corporation; and "Arofene" and "Arotap", both available from Ashland Chemical Company; as well as the resole precondensate available under the trade designation "BB077" from Neste Resins, a Division of Neste Canada, Inc., Mississauga, Ontario, Canada. Organic solvent may be added to the phenolic resin as needed or desired.

Preferably, the adhesive binder used as the make coat is foamed or frothed prior to its application to the fibers of the nonwoven web. The binder composition can be an aqueous dispersion of a binder that hardens upon drying. Most preferred among these binder compositions are foamable, coatable, hardenable resole phenolic resins comprising a surface active agent to assist in the formation of the foam and to enhance its stability. An exemplary commercially available surface active agent is that known under the trade designation "SULFOCHEM SLS" from Chemron Corporation of Paso Robles, Calif. Such foaming agents (emulsifiers) or surfactants are added to the make coat resin and are applied to the nonwoven web using coating methods compatible with liquid coatings. Amounts nearing 1.0% to 6.0%, and preferably about 3% of the total wet components have been used.

The foamable, coatable, hardenable resin composition useful as a make coat precursor in the present invention should be able to retain its foam form for a sufficient length of time to allow the application of the foam to the nonwoven web before the foam breaks significantly. Preferably, the foamed make coat will begin to break soon after its application to the nonwoven web so that the application of the abrasive particles can be accomplished in a manner which allows the particles to penetrate into the web beyond the uppermost surface layers of fibers. The resin compositions may be foamed by known methods, such as by mechanically foaming or frothing, by the injection and dispersion of insoluble gas, or by the use of chemical blowing agents that thermally or otherwise decompose to produce a gas-phase material. For the purposes of the present invention, the foamable, coatable, hardenable resin compositions should be foamable to a blow ratio, i.e., the ratio of foamed volume to that of the unfoamed starting material, of between 2:1 and 99:1. Phenolic foamed binder resin dispersions preferably will have a gas content of at least 20% by volume and more preferably between 50% and 99% (or a blow ratio of between 2:1 and 99:1, preferably between 5:1 and 25:1 and more preferably about 10:1). The labile foam must retain its structural integrity at least until the foam is applied to the fibers of the web in order to reduce the wet add-on weight of the resin being applied to the fiber layer. Foaming of the make coat provides a desired and economically attractive reduction in the add-on weight of the resin because the foamed resin is highly diluted with air, significantly increasing the volume of the resin while utilizing a smaller amount than would be required in the absence of foaming. The application of the foamed resin to the fibers of the web creates a substantially uniform monolayer of resin along the lengths of the fibers which, in turn, provides the bonding surface for the fine abrasive particles.

The foamed resin is applied to the nonwoven web to provide an amount when dried to provide a sheath-like covering over the fibers of the nonwoven web. For webs having the aforementioned fiber weights, the frothed phenolic make coat precursor add-on weight is preferably within the range from about 33 g/m$^2$ to about 105 g/m$^2$. The specific add-on weights to be used will depend on several factors such as the nature of the nonwoven web (e.g., fiber weights, fiber types and the like) as well as the nature of the resin being used. The determination of appropriate make coat add-on weights is well within the skill of those practicing in the field.

The abrasive particles suitable for inclusion in the abrasive articles of the present invention include all known fine abrasive particles. Preferably, such fine abrasive particles are provided in a distribution of particle sizes with a median particle diameter of about 60 microns or less. In the preparation of hand pads to be used in the aforementioned automotive applications, for example, the median particle diameter may be smaller than 60 microns. In such articles, a median particle diameter of 40 microns or less is somewhat more preferred. Included among the various types of abrasive materials useful in the present invention are particles of aluminum oxide including ceramic aluminum oxide, heat-treated aluminum oxide and white-fused aluminum oxide; as well as silicon carbide, alumina zirconia, diamond, ceria, cubic boron nitride, garnet, and combinations of the foregoing. Useful abrasive particles may also include softer, less aggressive materials such as thermosetting or thermoplastic polymer particles as well as crushed natural products such as nut shells, for example.

Those skilled in the art will appreciate that the selection of particle composition and particle size will depend on the contemplated end use of the finished abrasive article, taking into account the nature of the workpiece surface to be treated by the article and the abrasive effect desired. Preferably, the fine abrasive particles for inclusion in the articles of the invention comprise materials having a Moh's hardness of at least about 5, although softer particles may be suitable in some applications, and the invention is not to be construed as limited to particles having any particular hardness value. Preferably, in the manufacture of hand pads for use in the foregoing automotive applications, the fine abrasive particles comprise aluminum oxide particles having the foregoing distribution of particle sizes. The particles are added to at least one of the first or second major surfaces of the nonwoven web to provide a particle loading which is adequate for the contemplated end use of the finished article. In the preparation of articles for the aforementioned automotive application, for example, the fine abrasive particles may be applied to the web to provide an add-on weight within the range from about 63 to 168 g/m$^2$ (about 15 to 40 grains/24 in$^2$).

The size coat precursor may be the same as the above discussed make coat precursor, or it may be different than the make coat precursor. The size coat precursor can comprise any of the aforementioned resinous or glutinous adhesives such as phenolic resins, urea-formaldehyde resins, melamine resins, acrylate resins, urethane resins, epoxy resins, polyester resins, aminoplast resins, and combinations and mixtures of the foregoing. Preferably, the size coat precursor will comprise a resinous adhesive similar or identical to the adhesive used in the make coat precursor. More preferably, the size coat precursor will comprise either a thermosetting resin or a radiation curable resin. Most preferably, the size coat precursor will comprise a thermosetting phenolic resin, as described above. The size coat precursor preferably is foamed prior to its application to the make coat, again to reduce the wet add-on weight of the resin so that the abrasive particles are not buried within the resin coating and rendered unavailable for use in the initial applications of the finished article. Preferably, the size coat precursor is foamed to a blow ratio between about 5:1 and about 25:1, more preferably about 20:1. The foamed or frothed size coat precursor is preferably applied to the nonwoven web to provide an add-on weight which covers the abrasive particles with a thin and substantially uniform coating without burying the particles under the resin. Where the aforementioned foamed phenolic resins are applied to a nonwoven web having the aforementioned fiber weight, preferably, the dried add-on weight for the size coat is within the range from about 33 g/m$^2$ to about 105 g/m$^2$. However, the specific add-on weights will depend on several factors such as the nature of the nonwoven web (e.g., fiber weights, fiber types and the like) as well as the nature of the resin being used. The determination of appropriate size coat add-on weights is well within the skill of those practicing in the field.

The make coat precursor or the size coat precursor or both can contain optional additives, such as fillers, fibers, lubricants, grinding aids, wetting agents, surfactants, pigments, dyes, coupling agents, plasticizers, suspending agents, antistatic agents and the like. Possible fillers include calcium carbonate, calcium oxide, calcium metasilicate, alumina trihydrate, cryolite, magnesia, kaolin, quartz, and glass. Fillers than can function as grinding aids include cryolite, potassium fluoroborate, feldspar, and sulfur. Fillers can be used in amounts up to about 400 parts, preferably from about 30 to about 150 parts, per 100 parts of the make or size coat precursor, while retaining good flexibility and toughness of the cured coat. The amounts of these materials are selected to provide the properties desired, as known to those skilled in the art.

Organic solvent and/or water may be added to the precursor compositions to alter viscosity. Preferred viscosity values before foaming range between 10 to 10,000 cps (as measured using a Brookfield viscometer), usually between 50 to 1,000 cps, at room temperature (e.g., 25° C.). The selection of the particular organic solvent and/or water is believed to be within the skill of those practicing in the field and depends upon the thermosetting resin utilized in the binder precursor and the amounts of these resins utilized.

Figure 3:
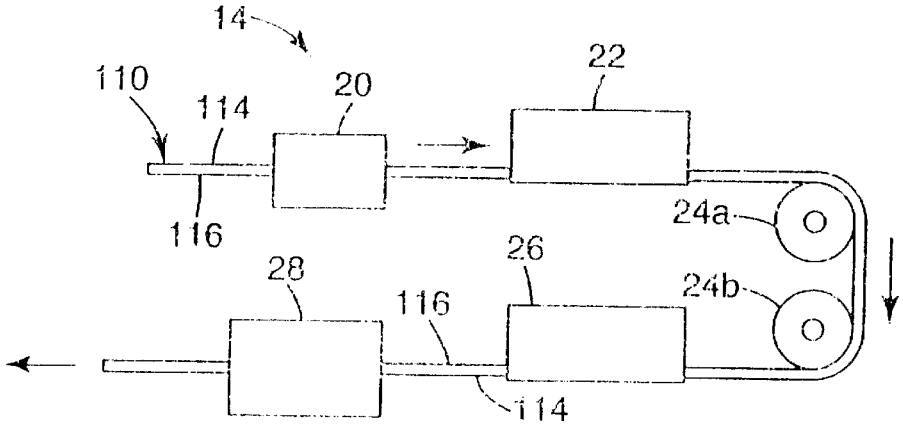
FIG. 3 is a partially schematic view of a method and apparatus for manufacturing lofty nonwoven abrasive articles according to the present invention.

As seen in FIG. 3, in the preparation of the articles of the invention the lofty nonwoven web 110 having first side 114 and second side 116 is fed into apparatus 14. At this stage, the nonwoven web 110 is preferably a pre-bonded web, not yet comprising abrasive particles. The nonwoven web 110 is first passed through coater 20 which applied first adhesive or make coat precursor to the web 110. The coater 20 can comprise any suitable coater known in the art, such as a spray coater, roll coater, dip coater, knife over roll coater, or the like. When applying the preferred foamed make coat precursor described below, the preferred coater 20 comprises a double roll coater with the web 110 passing through the nip formed by the two opposed rollers. Such coaters are well known in the art need not be further described herein. The foamed make coat precursor is applied to the top roller from a frother through a slot die as is known in the art. In one preferred embodiment, the frother is of the type commercially available as a "F2S-8" from SKG Industries, West Lawn, Pa. Other suitable arrangements for applying the frothed make coat precursor to the web include but are not limited to: applying the make coat precursor with a slot die to the bottom roll or to both rolls of a double roll coater; applying the make coat precursor with a slot die directly to the web prior to entering the nip of a double roll coater; applying the make coat precursor with a slot die without a roll coater and optionally by drawing a vacuum across the web opposite the slot die, applying the make coat precursor to both sides of the web with opposed slot dies with or without subsequently passing the web through a roll coater; and applying the make coat precursor with a hose or duct transversing across the web.

After exiting the first adhesive coater 20, web 110 passes through first particle coater 22. First particle coater 22 is preferably configured to apply abrasive particles 112 to the first surface 114 of the web. As explained further below, the abrasive grains 112 will penetrate from surface 114 to some depth into the web 110. When it is desired to apply abrasive grains to second side 116 of the web 110, the web passes over rollers 24*a* and 24*b* so as to re-orient the web to have second side 116 facing up. The web 110 then passes through an optional second particle coater 26 configured to apply abrasive particles 112 to the second side 116 of web 110. Preferably, second particle coater 26 is of like construction as first particle coater 22. However, for certain applications, it may be preferable to use second coater 26 of a different type or configuration from first particle coater 22. Also, the second abrasive particle coater 26 may apply abrasive particles having either the same or different composition and/or size as the abrasive particles applied by the first abrasive particle coater 22.

After applying fine abrasive particles 112 to at least the first surface 114 of web 110, and optionally to second surface 116, the web 110 is preferably exposed to a heat source (not illustrated), such as infrared lamps or an oven, to heat the make coat precursor to the extent necessary to at least partially cure the resin. In some applications, it may be preferable to fully cure the make coat precursor at this step. Heating can be done with any source giving sufficient heat distribution and air flow. Examples of suitable heat sources include forced air oven, convection oven, infrared heat and the like. It is also within the scope of the invention to use radiation energy. For heat-activatable thermosetting resin foams, it is preferred that heating be for a sufficient amount of time to at least drive off solvent (e.g., water) and initiate at least partial curing (cross-linking) of the resin.

In a preferred embodiment, the web 110 optionally passes through second adhesive or size precursor coater 28 to apply an optional but preferred size coat precursor to the web 110 after it exits the second abrasive particle coater 26. Preferably, the size precursor coater is of the same configuration as the make precursor coater 20. For some applications, it may instead be desired to use a coater 28 of a different configuration from that of the first coater 20. In some applications, it may be preferred not to add the size coat.

Figure 4:
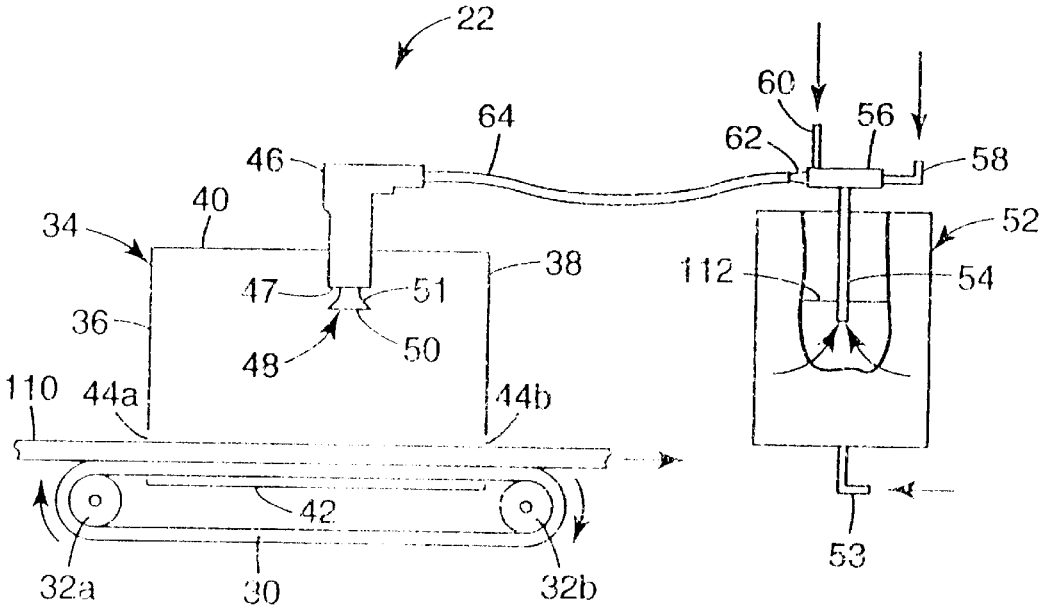
FIG. 4 is a partially schematic view of one embodiment of a particle coater according to the present invention.

A preferred embodiment of first particle coater 22 is illustrated in greater detail in FIG. 4. Web 110 is conveyed through the coater 2 by a carrier belt 30 which passes around rollers 32*a* and 32*b*, at least one of which is a drive roller. The web 110 passes through particle spray booth 34. Booth 34 includes first side 36, second side 38, top 40, and bottom 42. Booth 40 also includes front and back sides not illustrated. First side 36 includes entry slot 44*a* sized and configured to allow web 110 and carrier belt 30 to enter the booth 34. Second side 38 includes exit slot 44*b* sized and configured to allow web 110 and belt 30 to exit the booth 34. Slots 44*a*, 44*b* are located near the bottom of sides 36, 38 respectively. Mounted through an opening in the top 40 of the booth 34 is particle sprayer 46, having deflector 48 mounted at the exit 47 of the sprayer. The web 110, which at this point includes a make coat precursor thereon, is carried by belt 30 through the booth 34. As the web passes from entry slot 44*a* to exit slot 44*b*, particle sprayer 46 introduces particles 112 into the booth so as to coat the first side 114 of the web with abrasive particles. As described below, the particles 112 will penetrate to some depth into the web 110. The web 110, now comprising abrasive particles adhered to the web by the make coat precursor, then exists the booth 34.

In one preferred embodiment, the particle sprayer 46 receives an abrasive particle/air mixture from fluidizing bed 52. Abrasive particles 112 are fluidized in the bed 52 by fluidizing air (from a suitable source, not illustrated), introduced into the bed via fluidizing air inlet 53. The fluidizing air flow rate should be high enough to cause fluidization, without being so high so as to cause "worm holes" through the bed, i.e., a small number of discrete locations where the air passes through the particles without causing significant fluidization throughout the bed. The flow rate of fluidizing air should also be selected to minimize "stratification" of the particles 112, i.e., a state in which smaller particles tend to migrate toward the top of the bed while larger particles tend to migrate toward the bottom of the bed.

Atop the fluidizing bed 52 is a venturi inlet 56 as is well known in the art. In the illustrated embodiment, venturi 56 receives primary air from a suitable source via primary air inlet 58. The primary air passes through the venturi 56 drawing the mixture of fluidized particles and air through the draw tube 54 which extends from the venturi 56 into the fluidizing bed 52. Secondary air optionally can be added to the venturi inlet 56 via secondary air inlet 60. The secondary air is added to the flow of fluidized abrasive particles after the particles are drawn into the venturi to aid in delivering the fluidized abrasive particle/air mixture to the sprayer 46 via particle hose 64 which extends from the venturi exit 62 to the inlet of the particle sprayer 46.

The deflector 48 mounted in the exit 47 of the particle sprayer 46 redirects the fluidized abrasive particle/air mixture. Deflector 48 includes deflector top 49 (illustrated in FIGS. 5 and 6), deflector bottom 50, and deflector wall 51. To obtain the preferred uniform distribution of fine abrasive particles on web 110 described above, the present inventors have discovered that it is preferable to redirect the flow of the fluidized abrasive particle/air mixture so as not to spray the mixture directly into the web 110. Instead, the desired uniform distribution of abrasive particles 112 is achieved with the method and apparatus of the present invention by creating a uniformly dispersed cloud of abrasive particles in the spray booth 34 above the web 110 having the liquid make coat precursor thereon. The cloud then deposits, preferably by settling due to gravity onto the web 110 in the desired uniform patter. Such a uniformly dispersed cloud helps prevent the individual fine abrasive particles from agglomerating or clumping together. Instead, the abrasive particles settle from the cloud onto the web having the make coat thereon as illustrated in FIG. 4. In one preferred arrangement, the deflector bottom 50 has a diameter of 32 mm (1.26 inches), the bottom edge of the deflector extends 20 mm (0.79 inches) from the exit of the spray gun, and is held at a height of 155 mm (6.1 inches) above the nonwoven web 110. Of course, other arrangements fall within the scope of the present invention. For example, the size of the deflector, the shape of the deflector, the contour of wall 51, the number and location of particle sprayers 46, the height of the deflectors above the web, the speed of the web 110, ad the air pressure and ratio of abrasive particles in the particle/air mixture can each be varied. Such parameters can be varied to achieve the desired add-on weight of abrasive particles, the desired penetration into the web 110 of the abrasive particles, and the desired uniformity of the abrasive particles 112 on the web 110.

In one preferred embodiment, sprayer 46, fluidizing bed 52, and controller (not illustrated) is a commercially available system known as MPS 1-L Manual Powder System, including model PG 1-E Manual Enamel Powder Gun, available from Gema, an Illinois Tool Works Company, of Indianapolis, Ind., with a round deflector 48 substantially as illustrated in FIG. 4.

In another preferred embodiment, the abrasive particle spray apparatus is of the type commercially available from Binks Manufacturing Company (Sames), of Franklin Park, Ill., and includes a 50 lb. Fluidized bed, a GCM-200 Gun Control Module, a SCM-110 Safety control Module, a STAJET SRV Type 414 gun, with a standard powder pump.

Figure 5:
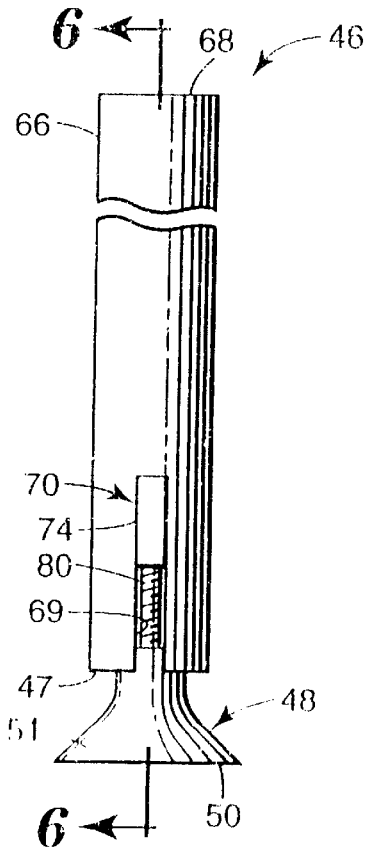
FIG. 5 is an elevational view of an alternate particle sprayer for use with the present invention.
Figure 6:
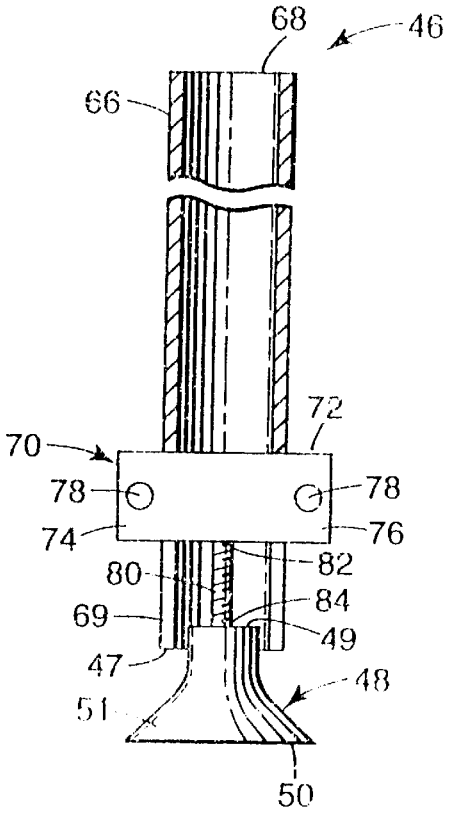
FIG. 6 is a partial cross-sectional view of the nozzle of FIG. 5 taken along line 6—6.

Another preferred embodiment of particle sprayer 46 is illustrated in FIGS. 5 and 6. In this embodiment, the sprayer comprises an elongate tube 66 having an exit 47 at one end and an inlet 68 at the opposite end of the tube. In use, this embodiment of the sprayer 46 has the abrasive particle/air mixture hose 64 attached to the inlet 68 as is illustrated with respect to the earlier described embodiment of FIG. 4. The embodiment of the sprayer 46 illustrated in FIGS. 5 and 6 is mounted in spray booth 34 and operates as described with respect to the embodiment of particle coater 22 illustrated in FIG. 4.

Returning to FIGS. 5 and 6, sprayer 46 includes particle deflector 48 mounted at exit 47 of tube 66. Deflector 48 is mounted to the tube 66 by any suitable mounting means. In one preferred embodiment, deflector mount 70 includes a base 72 comprising a generally rectangular plate having a first end 74 and a second end 76. Base 72 is sized and configured to fit in slot 69 in the end of tube 66 proximate the exit 47. Mount 70 can be permanently or removably mounted to the tube 66. In the illustrated embodiment, base 72 is releasably held in slots 69 by a spring, clip, or other suitable fastener (not illustrated) affixed to holes 78 in the first and second ends of base 72. Extending from base 72 is a threaded rod 80 having a first end 82 affixed to the base (such as by brazing, for example) and second end 84 extending beyond the exit 47 of tube 66. Threaded rod 82 is configured to engage with a like-threaded hole in the top 49 of deflector 48. This allows the position of deflector 48 to be conveniently adjusted with respect to the exit 47 of the tube 66 by rotating the deflector 48. This allows for varying the direction of motion of the particles 112 leaving the sprayer 46 as described above. Deflector 48 also includes bottom 50 opposite top 49, and deflector wall 51 extending between top 49 and bottom 50.

Figure 6A:
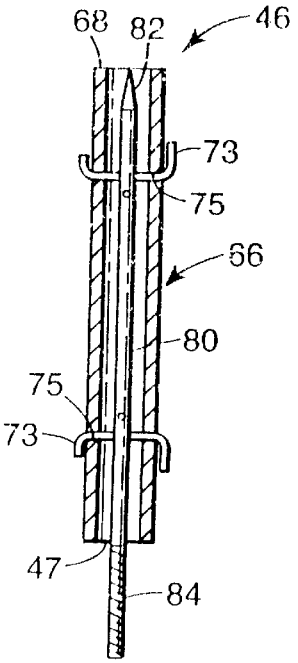
FIG. 6A is a view like FIG. 6 of an alternate embodiment of the nozzle.

An alternate embodiment of sprayer 46 is illustrated in FIG. 6A. In this embodiment, threaded rod 80 is elongated, and includes a tapered end 82 to help direct the flow of abrasive particles through tube 66. Pins 73 extend through holes 75 in the wall of the tube 66, and extend through holes in the rod 80, to mount the rod 80 in the sprayer 46. In one embodiment, the tapered end 82 of rod 80 ends at the inlet 68. In other embodiments, the end 82 can extend beyond the inlet 68, or the inlet may extend beyond the end 82 of the rod. Deflector 48 is mounted on threaded end 84 as described above.

The tube 66 and deflector 48 should be sized and configured to provide the desired uniform spray pattern of abrasive particles 112. In one preferred embodiment, tube 66 is approximately 61 cm (24 inches) long, has an inside diameter of 1.08 cm (0.425 inches), and an outside diameter of 1.27 cm (0.5 inches), and is constructed of stainless steel. It is understood that other sizes and materials of tube 66 fall within the scope of the present invention.

Figure 7:
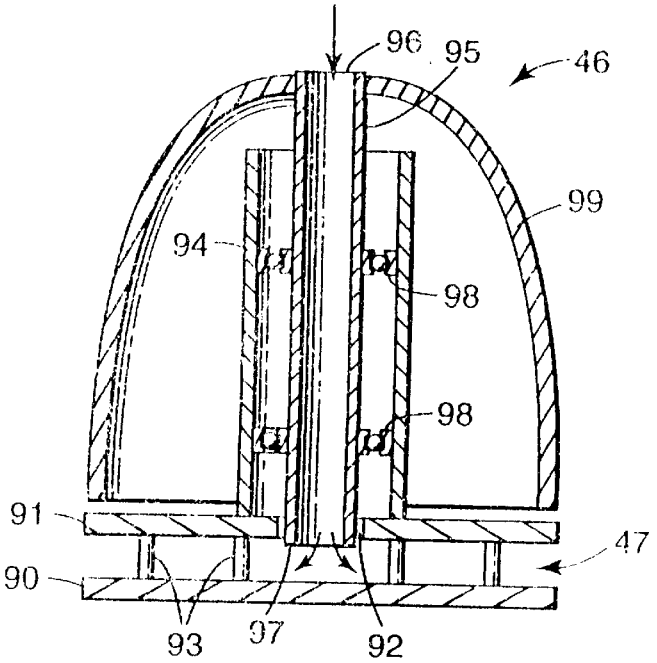
FIG. 7 is a cross-sectional view of a further alternate embodiment of a particle sprayer for use with the present invention.

Another preferred embodiment of the abrasive particle sprayer 46 is illustrated in FIG. 7. In this embodiment, the sprayer 46 comprises rotating first and second circular discs 90 and 91, respectively, joined by studs 93. Second disc 91 has a hole 92 in the center thereof. Second disc is joined to rotating shaft 94 which is concentric with the center hole 92. Rotating shaft 94 is rotatably mounted on the outside of stationary feed tube 95 by means of bearings 98, such that rotating shaft 94 is concentric with stationary feed tube 95. In this manner, rotating shaft 94, first plate 90, and second plate 91 are able to rotate together as a unit about stationary feed tube 95. The rotating shaft 94 can be driven by any suitable power means, such as an air motor (not illustrated). Feed tube 95 includes inlet 96 and outlet 97. In one preferred embodiment, inlet 96 of the feed tube 95 is attached to abrasive particle/air mixture hose 64, and the particle sprayer 46 is mounted on the top 40 of particle booth 34 as explained with regard to the embodiment of FIG. 4. In such an arrangement, the particle sprayer 46 receives fluidized abrasive particles from the fluidizing bed 52. In a variation of this embodiment, a vibratory feeder can be used in place of the fluidizing bed 52. The vibratory feeder is connected to feed abrasive particles into the inlet 96 of feed tube 95.

In operation, the rotating shaft 94 is driven so as to cause plates 90 and 91 to rotate. Abrasive particles pass through feed tube 95 and exit from outlet 97. Tube outlet 97 is positioned through hole 92 in second plate 91 such that the abrasive particles enter the space between first and second plates 90, 91. The abrasive particles strike the top surface of rotating plate 90, and will be dispersed through exit 47 in a direction generally parallel to the plane of first and second plates 90, 91. The particles preferably form a cloud that deposits, preferably by settling due to gravity onto the surface of web 110 as explained with regard to the embodiments described above. In one preferred embodiment, particle sprayer 46 comprises a Binks EPB-2000, commercially available from Binks Manufacturing Company (Sames), of Franklin Park, Ill., and the abrasive particles are fed to the particle sprayer by a vibratory pre-feeder commercial available as "Type 151" from Cleveland Vibratory Company, Cleveland, Ohio. The plates 90, 91 of the particle sprayer are preferably driven at 6,000 to 9000 RPM, however slower and faster speeds are within the scope of the present invention. The abrasive particle feed rate, type of particle feeder, and rotational speed of the plates can be selected to provide the desired abrasive particle spray pattern, desired abrasive particle add-on weight, and desired degree of penetration into web 110 of the abrasive particles.

What is common to the preferred embodiments described herein is that the particle sprayer includes means to change the direction of flow of particles 112 exiting the sprayer from perpendicular to the web 110, to a direction approaching, or exceeding, a plane parallel to web 110. Such directions are described with reference to the area immediately surround the exit 47 of particle sprayer 46. Thereafter, the particles 112 preferably disperse into a cloud of particles in the booth 34. The particles then settle from the cloud onto the web under the influences of gravity. Thus in one preferred embodiment of the inventive method, immediately before the particles adhere to web 110, gravity has a greater effect on the motion of the abrasive particles than does the momentum imparted by the particle sprayer 46. In some applications, the momentum imparted by the particle sprayer 46 will have little or no effect on the motion of the particles 112 immediately before the particles adhere to web 110. In other applications, for example where greater penetration of abrasive particles 112 into the web 110 is desired, the above apparatus parameters and configuration may be selected such that the downward momentum imparted to the particles 112 by the sprayer 46 will have a greater effect on the motion of the particles immediately before the particles adhere to the web.

In the embodiments described with respect to FIGS. 3, 5, and 6, the means for directing the flow of particles 112 exiting the particle sprayer 46 is the deflector wall 51 of deflector 48. Preferably, the location of the deflector 48 relative to the exit 47 of the particle sprayer can be varied to obtain the desired redirection of flow of abrasive particles 112 exiting the particle sprayer. It will be appreciated that without the deflector 48, the abrasive particles exiting the particle sprayer 46 will travel generally parallel to the longitudinal axis of the sprayer, which is generally perpendicular to the web 110. Generally, the closer the wall 51 and bottom 50 of the deflector are to the exit 47, the greater change in direction of motion of particles 112 from perpendicular to the web 110 will be. Moving the wall 51 and bottom 50 of the deflector further from the exit 47 will reduce the amount the direction of motion of the particles is varied from perpendicular to the web 110. In the embodiment described with respect to FIG. 7, the means for directing the flow of abrasive particles is the rotating plates 90, 91.

In some applications, it may be desirable to place hard insects, such as ceramic inserts, into those components of the apparatus 14 that are prone to wear under prolonged flow of abrasive particles through the components. This may be desirable, for example, in the particle sprayer 46, the venturi inlet 56, and the deflector 48. Such interest would prolong the useful life of certain components of apparatus 14, but would not be expected to have a significant effect on the performance of the apparatus.

For some applications, it is preferable to use a plurality of particle sprayers 46 in a single spray booth 34. Preferably, each of the particle sprayers are of like configuration, however it is understood that different types of particle sprayers could be used in a single booth. The particle sprayers 46 should be arranged in a pattern that provides a uniform coating of abrasive particles 112 to the web 110 as the web passes through the booth 34. This can be accomplished by arranging the plurality of particle sprayers 46 such that teach location across the width of the web 110 from first edge 117 to second edge 118 traverses through an equal number of spray patterns 45 caused by each of the particle sprayers 46. Exemplary particle sprayer arrangements are illustrated schematically in FIGS. 8A through 8D. These figures are schematic top views of the web 110 passing under the spray patterns 45 created by particle sprayers 46 mounted in the top 40 of the booth 34 (not shown). It is possible to vary the flow rates of each of the plurality of sprayers 46, or to use different configurations of sprayers 46 to obtain a desired coating pattern of abrasive particles 112 on web 110. It is also possible to oscillate or reciprocate the particle sprayers 46 to achieve a desired spray pattern as is known in the art.

When using a plurality of particle sprayers 46, it is possible to use a like number of particle coaters 22 as illustrated in FIG. 4, where each particle sprayer receives abrasive particles 112 for a respective fluidizing bed 52. In some applications it is preferable to feed a plurality of particle sprayers 46 from a single fluidizing bed 50. In one such arrangement, a plurality of venturi injectors 56 are mounted on a single fluidizing bed. In an alternate arrangement, a plurality of volumetric control auger feeders are mounted on the side wall of a fluidizing bed to draw a desired rate of fluidized abrasive particle/air mixture from the fluidizing bed 50. The operation and design of such feeders is well known and need not be further discussed. Each auger feeder deposits the abrasive particles into a venturi injector 56 as described above. Each venturi injector 56 is connected to an abrasive particle/air mixture hose 64 for conveying the abrasive particle/air mixture to a particle sprayer 46 as described above. In one preferred embodiment, the fluidizing bed 50 having a plurality of auger feeders mounted thereon is of the type commercially available as the "Powder Delivery Control Unit" Gema, and Illinois Tool Works Company, of Indianapolis, Ind. It is also within the scope of the invention for the auger feeder to feed abrasive particles from a volumetric feeder of the type commercially available as "Dry Material Feeder" from AccuRate of Whitewater, Wis.

It is also within the scope of the present invention to include additional particle sprayers configured to spray abrasive particles onto the web 110 with enough force to achieve greater penetration into the center portion of the web. Such additional particle sprayers can be included in the spray booth 34 along with the particle sprayers 46 described above, either in the arrangement of particle sprayers 46, or arranged to spray the web 110 before or after the web passes under sprayers 46. Such additional sprayers could also be arranged in a second particle spray booth before or after the sprayers 22, 26, described above. Preferably, the additional sprayers are arranged to deposit abrasive particles onto the web before the sprayers 46, so as not to disturb or disrupt the advantageous spray pattern achieved by the sprayers 46. Such a combination of sprayers can be used to provide a web 110 having the advantageous fine particle distribution at surfaces 114, 116 as described herein, along with particles in the center portion of the web for a longer-life abrasive article.

In one preferred embodiment, the web 110 has a width from first edge 117 to second edge 118 of 61 cm (24 inches) and is fed through apparatus 14 at a web speed of from about 3 to 30 meters/minute (10 to 100 feet/minute), more preferably 16 meters/minute (52.5 feet/minute). The first adhesive coater 20 is a double roll coater with the web 110 passing through the nip formed by the two opposed rollers. The foamed make coat precursor is applied to the top roller from a frother through a slot die as is known in the art. In one preferred embodiment, the frother is of the type commercially available as a "F2S-8" from SKG Industries, West Lawn, Pa. The abrasive particles 112 are applied by eight particle sprayers 46 generally as described with respect to FIGS. 5 and 6, fed by eight venturi injectors 56 mounted on a fluidizing bed 52. The spray pattern of the injectors is generally as illustrated with respect to FIG. 8B. The abrasive particles 112 preferably comprise aluminum oxide particles having a median particle size of about 60 microns, applied to each side in an amount of from about 63 to 168 grams/$m^2$ (about 15 to 40 grains per 24 square inch), more preferably in an amount of about 105 grams/$m^2$ per side (25 grains per 24 square inch). The make coat precursor is then partially cured. The second adhesive coater 26 preferably is of the same type as the first adhesive coater 20. The size coat precursor preferably has the same composition as the make coat precursor, is frothed to a desired blow ratio, and is applied in an amount to provide a suitable dry add-on weight as mentioned above. The parameters for the Gema particle coater described above are as follows: fluidizing air introduced through inlet 53 at a pressure of from about 2 to 15 psi; primary air introduced into inlet 58 of venturi 56 at a pressure of up to 90 psi, preferably 30 to 60 psi; secondary air introduced into inlet 60 at a pressure of from 0 to about 90 psi, preferably from 0 to about 20 psi.

The methods and apparatuses described herein provide the advantageous abrasive article as illustrated in FIG. 2. By applying the foamed make coat precursor in the manner described herein, the tendency for the make coat precursor to migrate to concentrate and agglomerate is reduced. In this manner, the fibers 100 of the web are uniformly coated with the make coat precursor, allowing the abrasive particles 102 to be coated onto and adhered to the fibers in a more uniform distribution. And by coating the make coat precursor and abrasive particles in different steps, the abrasive particles are less likely to be "buried" within the make coat as is prone to happen in the prior art method of applying a make coat precursor/abrasive particle slurry. In the finished articles made by the method and apparatuses of the invention, the size coat provides a light coating of resin over the fine abrasive particles without burying the particles within the resin. When observed under a microscope, for example, the individual particles are observed to be anchored to the fibers and to extend outwardly from the outer surfaces of the fibers. In this construction, the fine abrasive particles are positioned in the article to be immediately abrasively effective in the initial applications of the finished article. Moreover, the particles are strongly adhered to the fibers of the web to provide an abrasive article with a satisfactory work like.

TEST METHODS

In the Examples set forth below, the following test methods were employed.

Scuffing Test

A scuffing test was used to simulate the abrasive qualities of abrasive articles on typical painted automotive surfaces. The test specimens are prepared from poly(methyl) methacrylate sheet material ⅛ inch (3.2 mm) thick. Rockwell Ball Hardness of 90–105, available in 48×96-inch (1.22×2.44 m) sheets under the trade name "Acrylite" from American Cyanamid, Wayne, N.J. Following the removal of the protective covering from the top side of the acrylic sheet, a double coat of "PPG Black Universal Base Coat" paint (PPG Industries Inc., Automotive Finished Division, Cleveland, Ohio) was applied per the manufacturer's recommendations. The black base coat was painted over with three (3) double coats of "PPG Paint DAU 82, Clear" (PPG Industries, Inc., Automotive Finishes Division, Cleveland, Ohio) per the manufacturer's recommendations, allowing about 30 minutes of "flash time" between each double coat application. The coated sheets were allowed to air-dry for approximately 72 hours. 4-inch (10.2 cm) diameter test specimens were cut from the coated sheet with care taken to minimize the scratching of the painted surface. The cut discs were then baked at 150° F. (66° C.) in an oven, avoiding any contact with the coated surface, for about 16 hours to fully cure the paint coatings. The test specimens were then ready for testing.

The tests were conducted on a Schiefer Abrasion Machine (available from Frazier Precision Company, Gaithersburg, Md.) fitted with a spring clip retaining plate to secure the painted test specimen on the bottom turntable and a mechanical fastener ("3M Scotchmate Dual Lock" SJ3442 Type 170) to hold the abrasive composition on the upper turntable. For each test, the counter was set to run 500 revolutions. A 4-inch (10.2 cm) diameter disc of the abrasive article to be tested was cut and mounted on the upper turntable via the mechanical fastener. In the event that the abrasive article had contact surfaces significantly different from each other, notation was made as to which side was being tested. A previously-prepared 4-inch (10.2 cm) diameter painted acrylic disc was weighted to the nearest milligram ($W_1$) and mounted via the spring clip to the lower turntable with the painted surface facing up. A 10 lb. (4.55 kg) weight was placed on the load platform of the abrasion tester. If the abrasion tester is plumbed for wet testing, the water supply is shut off. The upper turntable was lowered to contact the painted acrylic disc under the full force of the load weight, and the machine was started. After 500 revolutions, the machine was turned off, the abrasive article removed from the upper turntable and discarded, and the painted acrylic disc was removed from the lower turntable. Any free dust or detritus was removed from the painted acrylic disc by wiping with a dry paper towel and the disc weighed gain ($W_2$). The difference $W_1-W_2$ is reported to the nearest milligram as "cut".

The test should not abrade the painted acrylic disc to the extent that any of the underlying black paint is removed. In the event that the abrasion progressed through the black layer, the test was repeated. In the event that the abrasion passes through the black layer on the second attempt, new painted acrylic discs should be prepared with additional layers of the clear coating.

MATERIALS DESCRIPTION

In the Examples that follow, the materials are referred to as follows:

Nylon Staple Fiber: is 12 denier (13.3 dtex)×38 mm nylon 6,6 staple fibers, commercially available under the trade designation "T-885" from DuPont Canada Inc., Mississauga, Ontario, Canada.

Phenolic Resin: is a resole precondensate commercial available under the trade designation "BB077" from Neste Resins Canada, a Division Of Neste Canada Inc., Mississauga, Ontario, Canada.

Antifoam: is a silicone antifoam compound commercially available under the trade designation "Q2" from Dow Corning Corp., Midland, Mich.

Surfactant: is a surfactant commercial available under the trade designation "Sulfochem SLS", from Chemron Corporation, Paso Robles, Calif.

Red Dye Premix: is a mixture consisting of 14 parts red pigment (Ciba-Geigy Corp., Pigments Division, Newport, Del.), two parts "Black Dye Nigro Eclacid" (Rite Industries, Inc., High Point, N.C.), and 84 parts water.

Abrasive Particles: is ANSI grade 280 and finer $Al_2O_3$ particles having a median particle diameter of about 28 microns

EXAMPLES

The following non-limiting examples further illustrate the utility, performance and comparative advantages of the articles of the invention. Unless otherwise indicated, all parts and percentages are by weight.

Example 1

A lofty, random air-laid fabric was formed on a "Rando Webber" machine (Rando Machine Corporation, Macedon, N.Y.) consisting of 147 g/m$^2$ of 12 denier×38 mm Nylon Staple Fibers. The web was approximately 61 cm wide. A prebond coating having the composition set forth in Table 1 was applied to the air-laid fabric to achieve a dry add-on weight of 109 g/m$^2$. The prebond was then cured in an oven at 170° C. for 105 seconds. A make coat precursor having the composition set forth in Table 1 was frothed using a frother (commercially available under the trade designation "F2S-8" from SKG Industries, West Lawn, Pa.) as per the manufacturer's recommended procedure with a blow ratio of about 17:1. The frothed make coating was delivered to the top roll of a two-roll coater via a slot die, whereby the frothed make coat precursor was applied to the previously-coated and cured prebonded web to provide a make coat dry add-on weight of 63 g/m$^2$. Abrasive Particles were applied to the uncured make coat precursor at an add-on weight of 105 g/m$^2$ to each side of the froth-coated web via a particle sprayer (commercially available under the trade designation "Sames EPB 2000", Binks Manufacturing company, Franklin Park, Ill.) operated at approximately 9,000 RPM. The Abrasive Particles were drop fed into the particle sprayer without feed air from a vibratory pre-feeder (commercially available under the trade designation "Type 151", Cleveland Vibratory Company, Cleveland, Ohio). The exit of the particle sprayer was adjusted to a sufficient height above the surface of the web to deposit particles across the entire surface of the web. The web was passed underneath the sprayer at a web speed of approximately 7.6 meters/minute (25 feet/minute). The abrasive-coated web was then cured in an oven at 148° C. for 72 seconds followed by further heating at 160° C. for 72 seconds. A size coat precursor of the composition shown in Table 1 was frothed at a blow ratio of about 17:1 and applied in the same manner as the make coat precursor to provide a dry size coat add-on weight of 92 g/m$^2$, and the size coat precursor was subjected to a final cure in an oven at 148° C. for 72 seconds followed by heating at 160° C. for 72 seconds. Test specimens were evaluated according to the Scuffing Test procedure. The results are summarized in Table 2.

Example 2

Figure 8A:
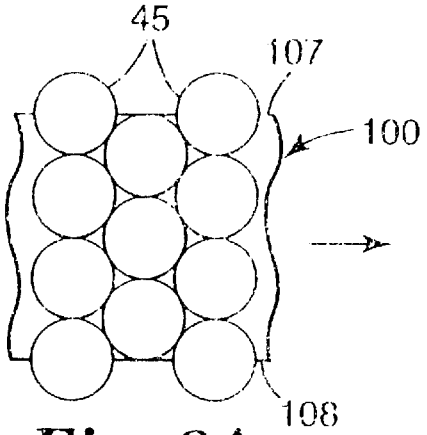
FIGS. 8A through 8D are schematic plan views of alternate patterns of the coating apparatus of the present invention.
Figure 8B:
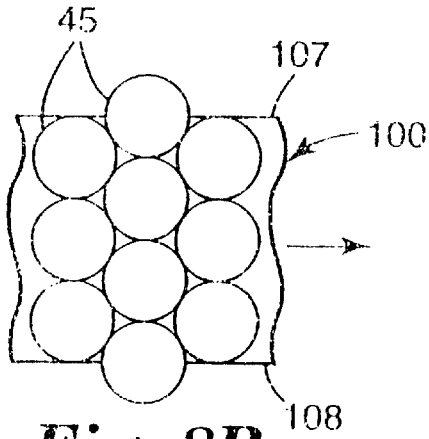
Figure 8C:
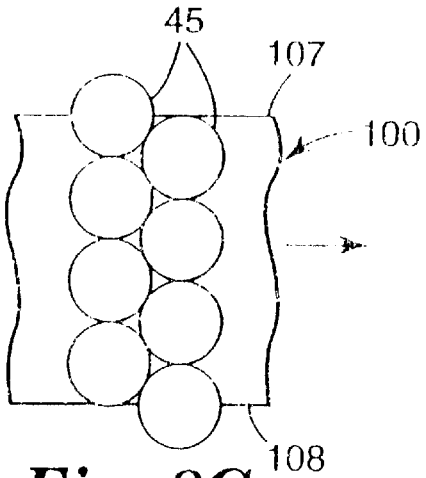
Figure 8D:
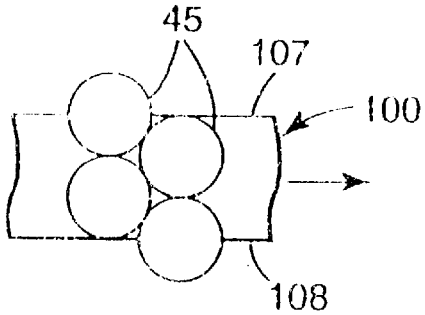

Example 2 was made according to the procedure and materials used in Example 1 with the following exceptions: 1) the compositions used as the prebond, make coat and size coat precursors are set forth as "Example 2" in Table 1; 2) the make coat precursor dry add-on weight was 50 g/m$^2$; 3) the size coat precursor dry add-on weight was 63 g/m$^2$; 4) Abrasive Particles were applied to only one side of the web with an add on weight of 105 g/m$^2$, applied by four particle sprayers of the type illustrated in FIG. 6A which were positioned generally as illustrated with respect to FIG. 8D at a height of 155 mm above the surface of the web. The particle sprayers were fed by four venturi injectors 56 mounted on a fluidizing bed 52 as described with respect to the embodiment illustrated in FIG. 3. The parameters for the particle coater were as follows: fluidizing air introduced through inlet 53 at a pressure of about 5 psi; primary air introduced into inlet 58 of venturi 56 at a pressure of about 60 psi; no secondary air was used, the 61 cm (24 inches) wide web was fed at a web speed of 15.4 meters/minute (50 feet/minute); 5) the make coat precursor was cured at only the 148° C. temperature for 72 seconds; and 6) the size coat precursor composition was cured at 148° C. for 432 seconds. Test specimens were tested according to the Scuffing Test, and the results are summarized in Table 2.

Comparative Example A

Comparative Example A is a commercially-available nonwoven abrasive surface conditioning material having the trade designation "SCOTCH-BRITE 07447 A-VFN General Purpose Hand Pad" available from the Minnesota Mining and Manufacturing Company of St. Paul, Minn. The pad comprises a nonwoven substrate having a fiber weight of about 147 g/m$^2$, a total resin weight of about 250 g/m$^2$ and a mineral loading of about 210 g/m$^2$. The mineral used in this pad is aluminum oxide of grade 280 and finer having a median particle diameter of about 28 microns. Comparative Example A was tested according to the Scuffing Test procedure, and the results are summarized in Table 2.

TABLE 1

Coating Compositions

| Coating | Component | Example 1 | Example 2 |
|---|---|---|---|
| Preband | Phenolic Resin | 73.2 parts | 73.2 parts |
| | water | 20 parts | 20 parts |
| | Red Dye Mix | 6 parts | 6 parts |
| | Antifoam | 0.015 parts | 0.015 parts |
| Make | Phenolic Resin | 62 parts | 60 parts |
| | water | 31 parts | 33 parts |
| | Surfactant | 3 parts | 3 parts |
| | Red Dye Mix | 4 parts | 3 parts |
| Size | Phenolic Resin | 62 parts | 60 parts |
| | water | 31 parts | 33 parts |
| | Surfactant | 3 parts | 3 parts |
| | Red Dye Mix | 4 parts | 3 parts |

TABLE 2

Scuffing Test

| Example | Initial weight, grams | Final weight, grams | Cut, grams removed | Average Cut, grams |
|---|---|---|---|---|
| 1 | 27.186 | 26.889 | 0.297 | |
| 1 | 27.048 | 26.730 | 0.318 | 0.308 |
| 2 | 27.333 | 27.034 | 0.299 | |
| 2 | 27.449 | 27.124 | 0.325 | |
| 2 | 27.598 | 27.297 | 0.301 | 0.038 |
| Comp. A | 25.807 | 25.724 | 0.083 | |
| Comp. A | 27.088 | 26.999 | 0.089 | |
| Comp. A | 25.807 | 25.724 | 0.083 | |
| Comp. A | 27.088 | 26.999 | 0.089 | 0.086 |

The results of the comparative testing in Table 2 indicate that the amount of cut for the articles of the invention are unexpectedly high and greatly in excess of the cut provided by the article of Comparative Example A. The article of Comparative Example A provided an average cut that was only 28% of the cut provided by the inventive pad of Example 2 and 28% of the cut provided by the inventive pad of Example 1.

The present invention can be used to abrade and/or polish a wide range of workpiece surfaces. These workpiece surfaces include metal (including mild steel, carbon steel, stainless steel, gray cast iron, titanium, aluminum and the like), metal alloys (copper, brass and the like), exotic metal alloys, ceramics, glass, wood (including pine, oak, maple elm, walnut, hickory, mahogany, cherry and the like), wood like materials (including particle board, plywood, veneers and the like) composites, painted surface, plastics (including thermoplastics and reinforced thermoplastics), stones (including jewelry, marble, granite, and semi precious stones), glass surfaces including glass television screens, windows (including home windows, office windows, car windows, air windows, train windows, bus windows and the like); glass display shelves mirrors and the like) and the like. The abrasive article may also be used to clean surfaces such as household items (including dishes, pots, pans and the like), furniture, walls, sinks, bathtubs, showers, floors and the like.

The workpiece may be flat or may have a shape or contour associated with it. Examples of specific workpieces include ophthalmic lenses, glass television screens, metal engine components (including cam shafts, crankshafts, engine blocks and the like), hand tools, metal forgings, fiber optic polishing, caskets, furniture, wood cabinets, turbine blades, painted automotive components, bath tubs, showers, sinks, and the like.

Depending upon the particular application, the force at the abrading interface can range from about 0.01 kg to over 100 kg, typically between 0.1 to 10 kg. Also depending upon the application, there may be a polishing liquid present at the interface between the abrasive article and the workpiece. This liquid can be water and/or an organic solvent. The polishing liquid may further comprise additives such as lubricants, oils, emulsified organic compounds, cutting fluids, soaps and the like. The abrasive article may oscillate at the polishing interface during use.

The abrasive article of the invention can be used by hand or used in combination with a machine. For example, the abrasive article may be secured to a random orbital tool or a rotary tool. At least one or both of the abrasive article and the workpiece is moved relative to the other.

The details of the preferred embodiment have been described in detail to provide an understanding and an appreciation of the invention. Of course, minor changes and modifications can be made to the preferred embodiment by those skilled in the art without departing from the spirit and the scope of the invention, as defined in the following claims.

We claim:

1. An abrasive article, comprising:

a nonwoven web of fibers bonded to one another, the fibers defining a first major web surface, a second major web surface and a middle web portion extending between the first and second major web surfaces, the fibers each having a surface and a length; and a plurality of abrasive particles adhered to the surfaces of the fibers of at least one of the first or second major web surfaces and distributed along the lengths of the fibers in a substantially uniform and continuous manner and substantially protruding from the fibers of the web, the particles comprising a distribution of particle sizes having a median particle of about 60 microns or less.

2. The article as defined in claim 1 wherein the fibers comprise materials selected from the group consisting of polyester, nylon, polypropylene, acrylic polymer, rayon, cellulose acetate polymer, polyvinylidene chloride-vinyl chloride copolymers, vinyl chloride-acrylonitrile copolymers, cotton, wool, jute, hemp and combinations of the foregoing materials.

3. The article as defined in claim 1 wherein the fibers are crimped staple fibers having a fineness within the range of about 1.5 to about 500 denier.

4. The article as defined in claim 1 wherein the fibers are adhesively bonded to one another at their mutual contact points within the web with a prebond resin comprising a cured thermosetting adhesive selected from the group consisting of phenolic resins, aminoplast resins having pendant $\alpha,\beta$-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof.

5. The article as defined in claim 1 wherein the fibers of the web comprise melt bondable bicomponent fibers wherein the fibers are bonded to one another at their mutual contact points by a melted component of the fibers.

6. The article as defined in claim 1 wherein the abrasive particles are adhered to the fibers of the nonwoven web by a cured thermosetting adhesive selected from the group consisting of phenolic resins, aminoplast resins having pendant α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof.

7. The article as defined in claim 6 wherein the cured thermosetting adhesive provides a substantially uniform resin layer over the fibers of the web.

8. The article as defined in claim 7 wherein the substantially uniform resin layer comprises separate make and size coatings.

9. The article as defined in claim 1 wherein the abrasive particles comprise material selected from the group consisting of aluminum oxide, silicon carbide, alumina zirconia, diamond, ceria, cubic boron nitride, garnet, and combinations thereof.

10. The article as defined in claim 9 wherein the aluminum oxide is selected from the group consisting of ceramic aluminum oxide, heat-treated aluminum oxide, white-fused aluminum oxide and combinations thereof.

11. The article as defined in claim 1 wherein the abrasive particles have a median diameter ranging from about 0.1 micron to about 60 microns.

12. The abrasive article as defined in claim 1 wherein the abrasive particles comprise materials selected from thermosetting polymer particles, thermoplastic polymer particles and combinations of the foregoing materials.

13. An abrasive article, comprising:

a lofty nonwoven web of fibers bonded to one another, the fibers defining a first major web surface, a second major web surface and a middle web portion extending between the first and second major web surfaces, the fibers each having a surface and a length; and a plurality of abrasive particles adhered by a cured thermosetting adhesive to the surfaces of the fibers of at least one of the first or second major web surfaces, the particles distributed along the lengths of the fibers in a substantially uniform and continuous manner and substantially protruding from the fibers of the web and the particles comprising a distribution of particle sizes having a median particle diameter of about 60 microns or less.

14. The article as defined in claim 13 wherein the fibers comprise materials selected from the group consisting of polyester, nylon, polypropylene, acrylic polymer, rayon, cellulose acetate polymer, polyvinylidene chloride-vinyl chloride copolymers, vinyl chloride-acrylonitrile copolymers, cotton, wool, jute, hemp and combinations of the foregoing materials.

15. The article as defined in claim 13 wherein the fibers are crimped staple fibers having a linear density within the range of about 1.5 to about 500 denier.

16. The article as defined in claim 13 wherein the fibers are adhesively bonded to one another at their mutual contact points within the web with a prebond resin comprising a cured thermosetting adhesive selected from the group consisting of phenolic resins, aminoplast resins having pendant α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof.

17. The article as defined in claim 13 wherein the fibers of the web comprise melt bondable bicomponent fibers wherein the fibers are bonded to one another at their mutual contact points by a melted component of said fibers.

18. The article as defined in claim 13 wherein the abrasive particles are adhered to the fibers of the nonwoven web by a cured thermosetting adhesive selected from the group consisting of phenolic resins, aminoplast resins having pendant α,β-unsaturated carbonyl groups, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, fluorene-modified epoxy resins, and combinations thereof.

19. The article as defined in claim 18 wherein the cured thermosetting adhesive provides a substantially uniform resin layer over the fibers of the web.

20. The article as defined in claim 13 wherein the abrasive particles comprise material selected from the group consisting of aluminum oxide, silicon carbide, alumina zirconia, diamond, ceria, cubic boron nitride, garnet, and combinations thereof.

21. The article as defined in claim 20 wherein the aluminum oxide is selected from the group consisting of ceramic aluminum oxide, heat-treated aluminum oxide, white-fused aluminum oxide and combinations thereof.

22. The article as defined in claim 13 wherein the abrasive particles have a median diameter ranging from about 0.1 micron to about 60 microns.

* * * * *